US008631979B1

(12) United States Patent
Reahard

(10) Patent No.: US 8,631,979 B1
(45) Date of Patent: Jan. 21, 2014

(54) CLOTHES HANGER

(71) Applicant: Patricia G. Reahard, Wabash, IN (US)

(72) Inventor: Patricia G. Reahard, Wabash, IN (US)

( * ) Notice: Subject to any disclaimer, the term of this patent is extended or adjusted under 35 U.S.C. 154(b) by 0 days.

(21) Appl. No.: 13/736,247

(22) Filed: Jan. 8, 2013

(51) Int. Cl.
*A41D 27/22* (2006.01)
*A47F 5/00* (2006.01)

(52) U.S. Cl.
USPC ..... 223/89; 211/118

(58) Field of Classification Search
USPC ..... 223/85–98; 211/113–118
See application file for complete search history.

(56) References Cited

U.S. PATENT DOCUMENTS

| | | | | |
|---|---|---|---|---|
| 2,058,217 | A * | 10/1936 | Dixon | 211/119 |
| 2,511,304 | A | 6/1950 | Swanson | |
| 2,644,589 | A * | 7/1953 | Levine | 211/118 |
| 3,352,430 | A | 11/1967 | McAfee | |
| 3,993,205 | A * | 11/1976 | Pilchard | 211/116 |
| 4,097,359 | A | 6/1978 | Davitz | |
| 4,253,577 | A * | 3/1981 | Macfarlane | 211/118 |
| D327,581 | S | 7/1992 | Fildan | |
| 6,070,773 | A | 6/2000 | Pogoda | |
| D433,821 | S | 11/2000 | Brutus et al. | |
| 6,974,057 | B1 | 12/2005 | Smith | |
| 7,624,900 | B2 | 12/2009 | McLaughlin | |
| 2006/0226179 | A1 * | 10/2006 | Hsu | 223/85 |
| 2009/0078726 | A1 * | 3/2009 | Boulet et al. | 223/85 |
| 2009/0078727 | A1 | 3/2009 | Hassel et al. | |
| 2009/0120974 | A1 * | 5/2009 | Rossaki | 223/94 |

* cited by examiner

*Primary Examiner* — Ismael Izaguirre
(74) *Attorney, Agent, or Firm* — Kyle Fletcher

(57) ABSTRACT

The clothes hanger includes a "U" shaped member that rotates along a horizontal axis with respect to an outer hanger member. The outer hanger member includes the hanger hook atop of which to enable the clothes hanger to hang from a hanger rod. The clothes hanger is adapted to enable a plurality of lingerie items or other small items from a single clothes hanger. The "U" shaped member is comprised of two vertical members that attach to the outer hanger bracket, and a horizontal member. The vertical members each include a plurality of hook members that are rotatable engaged thereon, and which rotate about a vertical axis to enable an end user to hook various items on the plurality of the hook members. The "U" shaped member is able to rotate with respect to the outer hanger bracket along a horizontal axis.

10 Claims, 3 Drawing Sheets

CLOTHES HANGER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of clothes hangers, and more specifically, a clothes hanger uniquely adapted for support a plurality of items of intimate clothing thereon.

B. Discussion of the Prior Art

As will be discussed immediately below, no prior art discloses a clothes hanger that includes a "U" shaped member that is rotatable engaged from within an outer hanger bracket; wherein the "U" shaped member is comprised of two vertical members that attach to the outer hanger bracket, and a horizontal member; wherein the vertical members each include a plurality of hook members that are rotatable engaged thereon, and which rotate about a vertical axis to enable an end user to hook various items on the plurality of the hook members; wherein the "U" shaped member is able to rotate with respect to the outer hanger bracket along a horizontal axis; wherein alternative embodiments include lateral members vertically spaced between the vertical members, and which include clip members to clip items thereon.

The Hassell et al. Patent Application Publication (U.S. Pub. No. 2009/0078727) discloses a garment drying hanger apparatus used for drying multiple items of lingerie, bathing suits, delicate articles of clothing, and similar items in an efficient space and manner. However, the hanger does not teach or disclose a "U" shaped member suspended within an outer hanger bracket, which is rotatable engaged there between and along a horizontal axis.

The McLaughlin Patent (U.S. Pat. No. 7,624,900) discloses a retractable multi-tiered lingerie hanger. However, the hanger does not teach or disclose a "U" shaped member suspended within an outer hanger bracket, which is rotatable engaged there between and along a horizontal axis.

The Pogoda Patent (U.S. Pat. No. 6,070,773) discloses a hanger for handling items of aparal, which cannot be hung easily on the conventional hangers, specifically lingerie. Again, the hanger does not include members that are able to rotate with respect to an outer hanger body.

The Swanson Patent (U.S. Pat. No. 2,511,304) discloses a multiple garment hanger that includes pivoting locking members. However, the pivoting locking members do not rotate about a vertical axis to provide a multitude of hooks for use in hanging multiple pieces of lingerie thereon.

The McAtee Patent (U.S. Pat. No. 3,352,430) discloses a swinging arm clothes rack. However, the rack does not rotate about a horizontal axis from within an outer hanger bracket.

The Smith Patent (U.S. Pat. No. 6,974,057) discloses a necktie and belt holding assembly. However, the assembly cannot support a plurality of pieces of lingerie, and which includes a "U" shaped member rotatably engaged from within an outer hanger bracket.

The Davitz Patent (U.S. Pat. No. 4,097,359) discloses a workpiece-supporting rack. Again, the rack does not includes a "U" shaped member rotatably engaged from within an outer hanger bracket The Fildan Patent (U.S. Pat. No. Des. 327,581) illustrates an ornamental design for a hanger for brassieres, lingerie, and swimsuits.

While the above-described devices fulfill their respective and particular objects and requirements, they do not describe a clothes hanger that includes a "U" shaped member that is rotatable engaged from within an outer hanger bracket; wherein the "U" shaped member is comprised of two vertical members that attach to the outer hanger bracket, and a horizontal member; wherein the vertical members each include a plurality of hook members that are rotatable engaged thereon, and which rotate about a vertical axis to enable an end user to hook various items on the plurality of the hook members; wherein the "U" shaped member is able to rotate with respect to the outer hanger bracket along a horizontal axis; wherein alternative embodiments include lateral members vertically spaced between the vertical members, and which include clip members to clip items thereon. In this regard, the clothes hanger departs from the conventional concepts and designs of the prior art.

SUMMARY OF THE INVENTION

The clothes hanger includes a "U" shaped member that rotates along a horizontal axis with respect to an outer hanger member. The outer hanger member includes the hanger hook atop of which to enable the clothes hanger to hang from a hanger rod. The clothes hanger is adapted to enable a plurality of lingerie items or other small items from a single clothes hanger. The "U" shaped member is comprised of two vertical members that attach to the outer hanger bracket, and a horizontal member. The vertical members each include a plurality of hook members that are rotatable engaged thereon, and which rotate about a vertical axis to enable an end user to hook various items on the plurality of the hook members. The "U" shaped member is able to rotate with respect to the outer hanger bracket along a horizontal axis. Alternative embodiments include lateral members vertically spaced between the vertical members, and which include clip members to clip items thereon.

It is an object of the invention to provide a single clothes hanger that is able to hang multiple pieces of lingerie or other small garments therefrom via rotating hooks or lateral members, and which is collectively configured to rotate with respect to an outer hanger bracket.

A further object of the invention is to provide a "U" shaped member that is able to rotate about a horizontal axis with respect to the outer hanger bracket.

A further object of the invention is to provide a clothes hanger that has an overall size and shape consistent with a traditional clothes hanger, and which is able to hang from a closet rod, and which can store a plurality of small garments therefrom.

These together with additional objects, features and advantages of the clothes hanger will be readily apparent to those of ordinary skill in the art upon reading the following detailed description of presently preferred, but nonetheless illustrative, embodiments of the clothes hanger when taken in conjunction with the accompanying drawings.

In this respect, before explaining the current embodiments of the clothes hanger in detail, it is to be understood that the clothes hanger is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the clothes hanger.

It is therefore important that the claims be regarded as including such equivalent construction insofar as they do not depart from the spirit and scope of the clothes hanger. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 5 illustrates a front view of a third embodiment wherein rotating hook members are located on each of the vertical members and horizontal members span there between.

DETAILED DESCRIPTION OF THE EMBODIMENT

Figure 1:
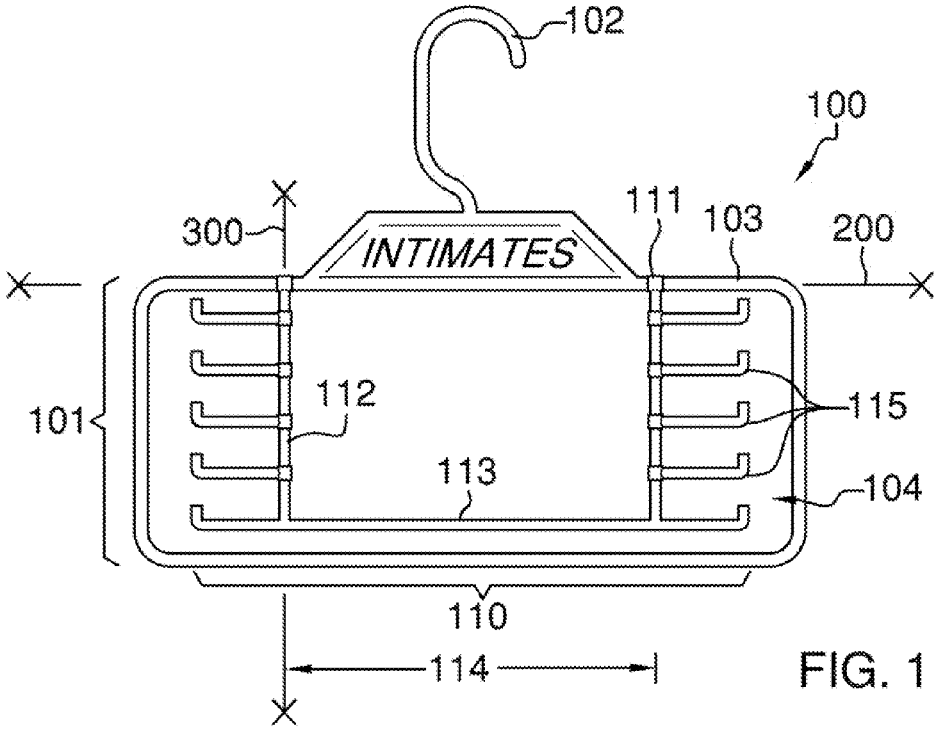
FIG. 1 illustrates a front view of a first embodiment of a clothes hanger, which includes a plurality of rotating hooks on each of the vertical members.
Figure 2:
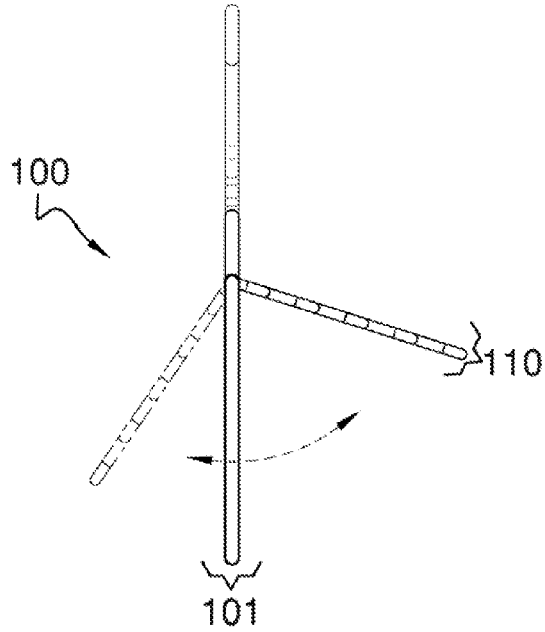
FIG. 2 illustrates a side view of the first embodiment, and depicting the rotation of the "U" shaped member with respect to the outer hanger bracket via the horizontal axis.
Figure 3:
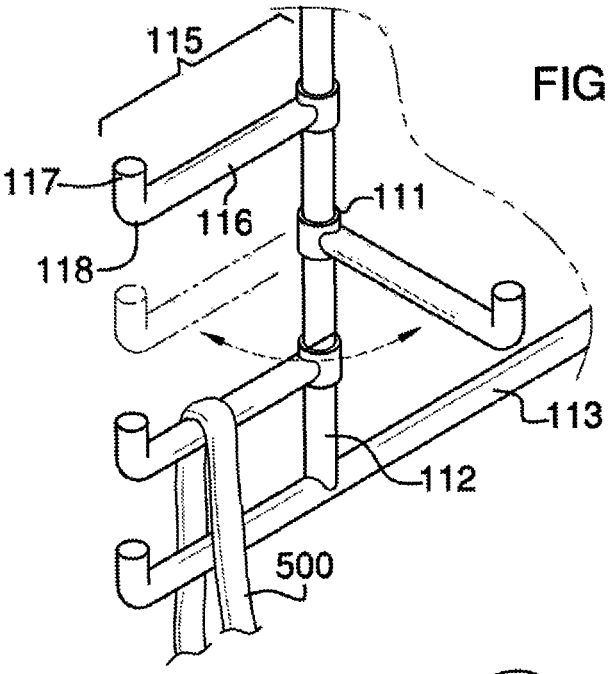
FIG. 3 illustrates a detailed view of one of the rotating hooks rotating along a vertical axis with respect to the vertical member of the "U" shaped member.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A clothes hanger 100 (hereinafter invention) includes an outer hanger bracket 101 from which a hanger hook 102 extends vertically from a top member 103. The outer hanger bracket 101 is of wire construction, and features a rectangular shape with an open center 104. A "U" shaped member 110 is affixed to the outer hanger bracket 101, and fits within the open center 104. Moreover, the "U" shaped member 110 includes rotating members 111 that attach to the top member 103 of the outer hanger bracket 101 such that the "U" shaped member 110 is able to rotate about the outer hanger bracket 101. It shall be noted that the "U" shaped member 110 rotates with respect to the outer hanger bracket 101 along a horizontal axis 200.

The "U" shaped member 110 is further characterized as including two vertical members 112, which extend downwardly from the rotating members 111. The vertical members 112 are rigidly affixed to one another via a lateral member 113. The vertical members 112 are generally parallel with one another, and are separated via a lateral member length 114. The lateral member length 114 defines the length of the lateral member 113.

The vertical members 112 each include a plurality of hook members 115 thereon. The hook members 115 are equally spaced along the vertical members 112, and rotate about a vertical axis 300. The hook members 115 each include a rotating member 111, and are able to rotate away from within the open center 104. The hook members 115 are provided to enable a plurality of pieces of lingerie 500 therefrom. It shall be noted that the term "lingerie" is being used to refer to actual items of lingerie or other small pieces of garments that extend beyond the realm of lingerie, which may include socks, scarves, belts, ties, brassieres, panties, teddies, etc.

The hook members 115 are each comprised of a first lateral hook member 116 that is horizontally-oriented, and from which a first longitudinal hook member 117 is perpendicular engaged at a distal end 118.

Figure 4:
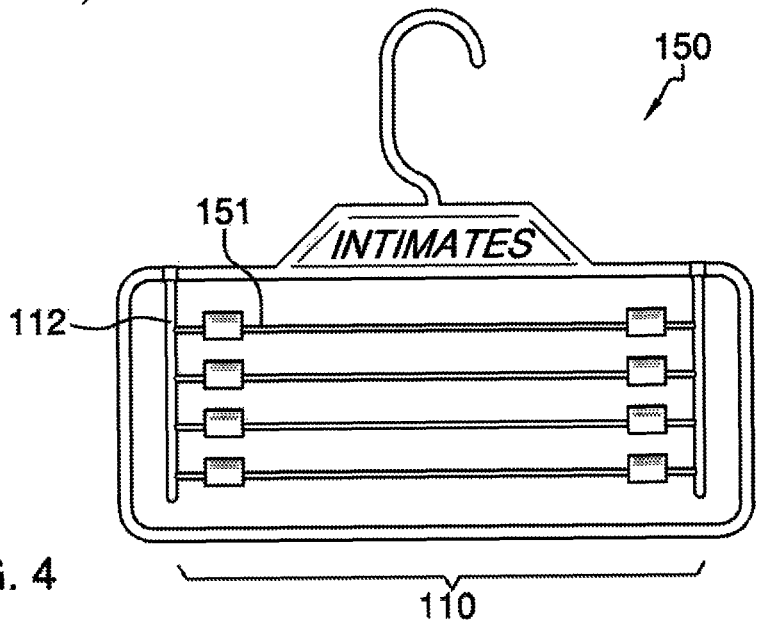
FIG. 4 illustrates a front view of a second embodiment that includes horizontal members spanning between the vertical members and including clip members thereon.

In referring to FIG. 4, a second embodiment of the invention 150 shall include a modified "U" shaped member wherein the hook members 115 are exchanged with alpha lateral members 151 that span in between the vertical members 112. The alpha lateral members 151 each include a plurality of clip members 152 that clip onto the alpha lateral members 151 in order to secure lingerie 500 thereon.

Figure 5:
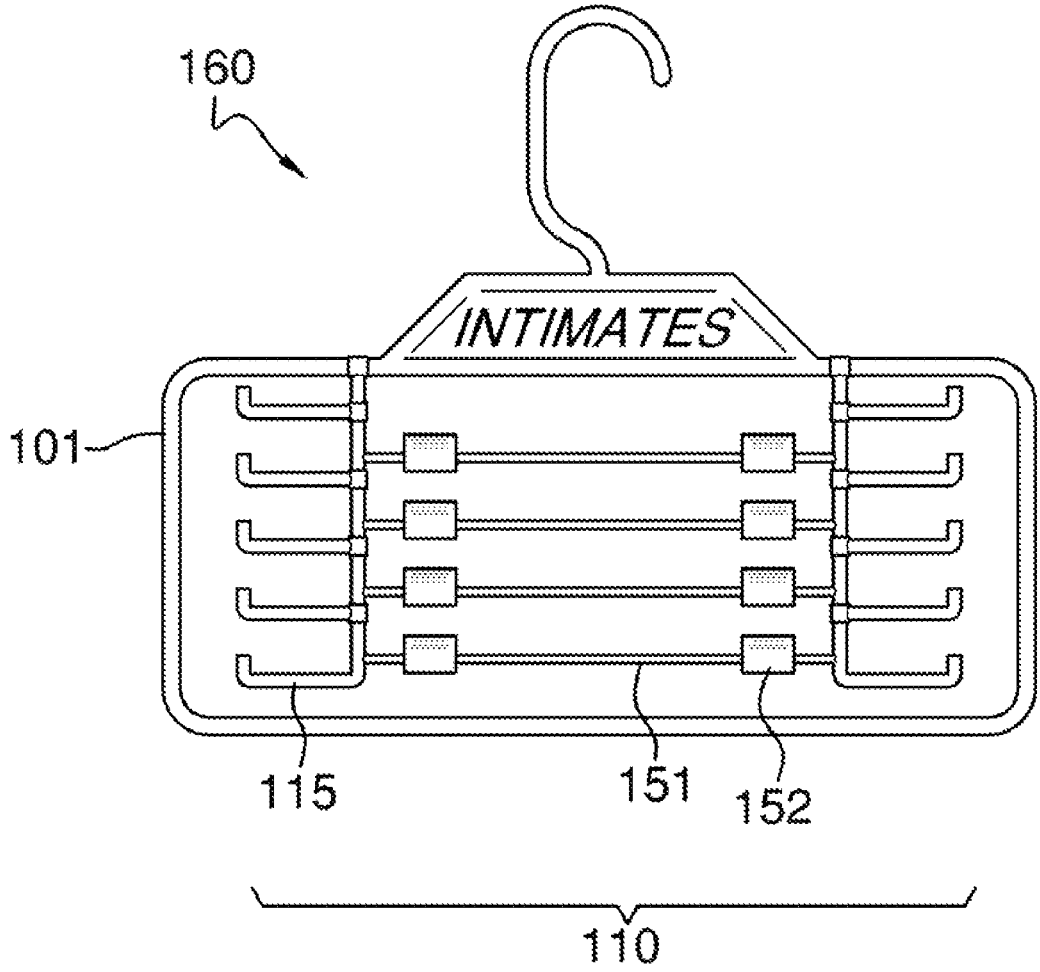

In referring to FIG. 5, a third embodiment of the invention 160 takes a hybridized approach between the invention 100 and the second embodiment of the invention 150. Moreover, the "U" shaped member 110 includes both the hook members 115 as well as the alpha lateral members 151 with their respective clip members 152.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A clothes hanger capable of hanging a plurality of pieces of lingerie comprising:

an outer hanger bracket defining an open center within which a "U" shaped member is rotatably engaged and able to hang a plurality of pieces of lingerie therefrom;

wherein the "U" shaped member is able to rotate about a horizontal axis with respect to the outer hanger bracket;

wherein the outer hanger bracket is further defined as including a hanger hook, which extends vertically from a top member; wherein the outer hanger bracket is of wire construction, and features a rectangular shape with the open center therein;

wherein the "U" shaped member is affixed to the outer hanger bracket, and fits within the open center; wherein the "U" shaped member includes rotating members that attach to the top member of the outer hanger bracket such that the "U" shaped member is able to rotate about the outer hanger bracket via the horizontal axis;

wherein the "U" shaped member is further characterized as including two vertical members, which extend downwardly from the rotating members; wherein the vertical members are rigidly affixed to one another via a lateral member; wherein the vertical members are generally parallel with one another, and are separated via a lateral member length defining the length of the lateral member;

wherein the vertical members each include a plurality of hook members thereon; wherein the hook members are equally spaced along the vertical members, and rotate about a vertical axis; wherein the hook members each include a rotating member, and are able to rotate away from within the open center of the outer hanger bracket.

2. The clothes hanger as described in claim 1 wherein the hook members are each comprised of a first lateral hook member that is horizontally-oriented, and from which a first longitudinal hook member is perpendicular engaged at a distal end.

3. The clothes hanger as described in claim 1 wherein the "U" shaped member includes alpha lateral members that span between the vertical members; wherein the alpha lateral members are generally parallel with one another; wherein the alpha lateral members are equally spaced with respect to one another; wherein the alpha lateral members each include clip members that enable pieces of lingerie to be clipped thereon.

4. The clothes hanger as described in claim 3 wherein the vertical members each include a plurality of hook members thereon; wherein the hook members are equally spaced along the vertical members, and rotate about a vertical axis; wherein the hook members each include a rotating member, and are able to rotate away from within the open center of the outer hanger bracket.

5. The clothes hanger as described in claim 4 wherein the hook members are each comprised of a first lateral hook member that is horizontally-oriented, and from which a first longitudinal hook member is perpendicular engaged at a distal end.

6. A clothes hanger capable of hanging a plurality of pieces of lingerie comprising:

an outer hanger bracket defining an open center within which a "U" shaped member is rotatably engaged and able to hang a plurality of pieces of lingerie therefrom;

wherein the "U" shaped member is able to rotate about a horizontal axis with respect to the outer hanger bracket;

wherein the outer hanger bracket is further defined as including a hanger hook, which extends vertically from a top member; wherein the outer hanger bracket is of wire construction, and features a rectangular shape with the open center therein;

wherein the "U" shaped member is affixed to the outer hanger bracket, and fits within the open center; wherein the "U" shaped member includes rotating members that attach to the top member of the outer hanger bracket such that the "U" shaped member is able to rotate about the outer hanger bracket via the horizontal axis;

wherein the "U" shaped member is further characterized as including two vertical members, which extend downwardly from the rotating members; wherein the vertical members are rigidly affixed to one another via a lateral member; wherein the vertical members are generally parallel with one another, and are separated via a lateral member length defining the length of the lateral member;

wherein the vertical members each include a plurality of hook members thereon; wherein the hook members are equally spaced along the vertical members, and rotate about a vertical axis; wherein the hook members each include a rotating member, and are able to rotate away from within the open center of the outer hanger bracket.

7. The clothes hanger as described in claim 6 wherein the hook members are each comprised of a first lateral hook member that is horizontally-oriented, and from which a first longitudinal hook member is perpendicular engaged at a distal end.

8. The clothes hanger as described in claim 6 wherein the "U" shaped member includes alpha lateral members that span between the vertical members; wherein the alpha lateral members are generally parallel with one another; wherein the alpha lateral members are equally spaced with respect to one another; wherein the alpha lateral members each include clip members that enable pieces of lingerie to be clipped thereon.

9. The clothes hanger as described in claim 8 wherein the vertical members each include a plurality of hook members thereon; wherein the hook members are equally spaced along the vertical members, and rotate about a vertical axis; wherein the hook members each include a rotating member, and are able to rotate away from within the open center of the outer hanger bracket.

10. The clothes hanger as described in claim 9 wherein the hook members are each comprised of a first lateral hook member that is horizontally-oriented, and from which a first longitudinal hook member is perpendicular engaged at a distal end.

* * * * *